US009976251B2

(12) United States Patent
Padilla et al.

(10) Patent No.: US 9,976,251 B2
(45) Date of Patent: May 22, 2018

(54) ROPE HAVING A LOW-FRICTION STRAND

(71) Applicant: Actuant Corporation, Menomonee Falls, WI (US)

(72) Inventors: Luis S. Padilla, Davidson, NC (US); Philip Samuel Bull, Shropshire (GB); Randy S. Longerich, Bellingham, WA (US); Aaron M. Vodnick, Warwick, RI (US)

(73) Assignee: Actuant Corporation, Menomonee Falls, WI (US)

( * ) Notice: Subject to any disclaimer, the term of this patent is extended or adjusted under 35 U.S.C. 154(b) by 322 days.

(21) Appl. No.: 14/155,317

(22) Filed: Jan. 14, 2014

(65) Prior Publication Data

US 2014/0196596 A1 Jul. 17, 2014

Related U.S. Application Data

(60) Provisional application No. 61/752,195, filed on Jan. 14, 2013.

(51) Int. Cl.
*D07B 1/04* (2006.01)
*D07B 7/02* (2006.01)
(Continued)

(52) U.S. Cl.
CPC ..... *D07B 1/04* (2013.01); *D04C 1/12* (2013.01); *D07B 1/025* (2013.01); *D07B 7/02* (2013.01); *D07B 2201/102* (2013.01); *D07B 2201/1012* (2013.01); *D07B 2201/1014* (2015.07); *D07B 2201/1024* (2013.01); *D07B 2201/1096* (2013.01); *D07B 2201/2036* (2013.01); *D07B 2201/2044* (2013.01);
(Continued)

(58) Field of Classification Search
CPC ..... D07B 1/025; D07B 1/04; D04C 1/12
See application file for complete search history.

(56) References Cited

U.S. PATENT DOCUMENTS 3,402,547 A 9/1968 Parsey
3,699,768 A 10/1972 Roberts et al.
(Continued)

FOREIGN PATENT DOCUMENTS

CN 1625618 6/2005
CN 101115873 1/2008
(Continued)

OTHER PUBLICATIONS

PCT/US2015/026471 International Search Report and Written Opinion dated Jul. 24, 2015 (14 pages).
(Continued)

*Primary Examiner* — Shaun R Hurley
(74) *Attorney, Agent, or Firm* — Michael Best & Friedrich LLP

(57) ABSTRACT

A rope and a method of constructing the rope. The rope may be of 12×12 braided construction and include a core for its length. The rope includes a plurality of primary strands, and each of the primary strands includes a plurality of fibers which may be made of a high-friction material. The rope also includes a secondary strand surrounded by the plurality of primary strands. The secondary strand includes a plurality of fibers which may be made of a low-friction material.

23 Claims, 7 Drawing Sheets

(51) Int. Cl.
*D04C 1/12* (2006.01)
*D07B 1/02* (2006.01)

(52) U.S. Cl.
CPC ..... *D07B 2201/2055* (2013.01); *D07B 2201/2057* (2013.01); *D07B 2201/2066* (2013.01); *D07B 2201/2067* (2013.01); *D07B 2205/205* (2013.01); *D07B 2205/2014* (2013.01); *D07B 2205/2042* (2013.01); *D07B 2205/2064* (2013.01); *D07B 2205/2071* (2013.01); *D07B 2401/207* (2013.01)

(56) References Cited

U.S. PATENT DOCUMENTS 3,791,658 A 2/1974 Zumeta et al.
4,120,145 A 10/1978 Chiappella et al.
4,270,341 A 6/1981 Glushko et al.
5,067,384 A 11/1991 Scala
6,945,153 B2 9/2005 Knudsen et al.
7,036,298 B2 5/2006 Honda
7,047,860 B2 5/2006 Faborsky
7,168,231 B1 * 1/2007 Chou ..... D02G 3/443 57/210
7,296,394 B2 11/2007 Clough et al.
7,409,815 B2 8/2008 Clough et al.
7,823,496 B2 11/2010 Bosman et al.
8,020,480 B2 9/2011 Magner
2004/0069132 A1 4/2004 Knudsen et al.
2005/0069703 A1 3/2005 He et al.
2005/0288775 A1 * 12/2005 Dong ..... A61F 2/07 623/1.54
2006/0179812 A1 8/2006 Clough et al.
2006/0182962 A1 8/2006 Bucher et al.
2006/0207414 A1 9/2006 Nye
2006/0213175 A1 * 9/2006 Smith ..... B66B 7/06 57/237
2007/0062174 A1 * 3/2007 Clough ..... D07B 1/068 57/212
2007/0202329 A1 8/2007 Davis et al.
2009/0078922 A1 3/2009 Kempf et al.
2009/0165637 A1 7/2009 Bosman et al.
2009/0245941 A1 10/2009 Magner
2012/0067020 A1 * 3/2012 Paddock ..... D07B 1/025 57/17
2012/0297746 A1 * 11/2012 Chou ..... D07B 1/02 57/230

FOREIGN PATENT DOCUMENTS

EP 1582493 10/2005
EP 1586526 10/2005
FR 1599318 7/1970
FR 2576045 7/1986
WO 2004082724 9/2004
WO 2005019525 3/2005
WO 2006002439 1/2006
WO 2013072941 5/2013
WO 2014110599 7/2014
WO 201480012972 7/2016

OTHER PUBLICATIONS

Search Report from the International Searching Authority for International Application No. PCT/US2014/011545 dated May 20, 2014 (8 pages).
Written Opinion from the International Searching Authority for International Application No. PCT/US2014/011545 dated May 20, 2014 (7 pages).
First Office Action from the State Intellectual Property Office of the People's Republic of China for Application No. 201480012972.0 dated Jul. 22, 2016 ( 21 pages).
Second Office Action from the State Intellectual Property Office of the People's Republic of China for Application No. 201480012972.0 dated May 17, 2017 (9 pages).
First Office Action from the Australian Intellectual Property Office for Application No. 2014205084 dated Mar. 21, 2017 (8 pages).
EP14737687 Extended European Search Report dated Dec. 21, 2016 (14 pages).
McKenna et al., Hanbook of Fibre Rope Technology, handbook (2004) 10 pages, Woodhead Publishing Ltd., England.
Cortland, "Ship and Barge Mooring Lines," website (2012) 10 pages, www.cortlandcompany.com/products/synthetic-rope-and-strength-members/ship-and-bar.
United States Patent Office Action for U.S. Appl. No. 14/760,961 dated Jan. 5, 2018 (7 pages).

* cited by examiner

ROPE HAVING A LOW-FRICTION STRAND

RELATED APPLICATIONS

This application claims the benefit of prior-filed, U.S. Provisional Application No. 61/752,195, filed Jan. 14, 2013, the entire contents of which is hereby incorporated by reference.

FIELD

This invention generally relates to a reduced-wear synthetic fiber rope for various marine applications, particularly, a rope having a low-friction strand.

SUMMARY

Synthetic fiber ropes are used to carry tensile loads in various applications, such as working and lifting, towing, buoy mooring, tug and salvage operations, ship and barge mooring, commercial fishing, etc. The useful life of such ropes is limited due to wear of the individual fibers, which may be caused, to some extent, by the friction of the fibers rubbing against each other. The fibers rub against each other, for example, when a rope passes over a sheave or as the rope moves from a slack configuration to a configuration in which it carries a tensile load.

Prior attempts to alleviate friction and wear in the rope have included intertwining low-friction fibers with the high-friction fibers of the rope and adding lubricant or lubricating fibers to the rope. Such solutions may fail to achieve the desired reduction in friction and rope wear and may present independent shortcomings, for example, reduced rope performance (e.g., reduced friction in winching, splicing of the rope).

As such, a need exists for a rope with, for example, a longer useful life, improved performance, etc., compared to previous ropes. Such a rope may be subjected to less wear due to reduced friction between the rope's fibers while achieving acceptable performance in applications in which outer surface friction may be desired (e.g., winching, splicing, etc.).

In one independent aspect, a rope may generally include a plurality of primary strands each including a plurality of fibers formed of a high-friction material, the plurality of primary strands defining an outer surface and a longitudinal center passageway of the rope; and a non-load bearing secondary strand having a strand outer surface and disposed within the longitudinal center passageway of the rope, the secondary strand including, at least on the strand outer surface, a plurality of structurally stable fibers formed of a non-flowable, low-friction material.

In another independent aspect, a rope may generally include a plurality of outer strands together defining an outermost surface of the rope and a longitudinally-extending center passageway of the rope, each of the plurality of outer strands including a plurality of fibers formed of a high-friction material, the high-friction material defining a first coefficient of friction with itself; and a core strand disposed within the longitudinally-extending center passageway of the rope and separated from the outermost surface of the rope by at least one of the plurality of outer strands at all positions along a length and about a circumference of the rope, the core strand including a plurality of structurally stable fibers formed of a non-flowable, low-friction material, the non-flowable low-friction material defining a second coefficient of friction with the high-friction material, the second coefficient of friction being less than the first coefficient of friction.

In yet another independent aspect, a rope may generally include twelve outer strands together defining a longitudinally-extending center passageway of the rope, the twelve outer strands being braided in a single braid pattern, each of the twelve outer strands including twelve sub-strands braided in a single braid pattern, each of the sub-strands including a plurality of synthetic fibers; and a core strand disposed in the longitudinally-extending center passageway over the length of the rope, the core strand including a plurality of fibers.

In a further independent aspect, a method of constructing a rope may generally include providing a non-load bearing secondary strand having a strand outer surface, the secondary strand including, at least on the strand outer surface, a plurality of structurally stable fibers formed of a non-flowable, low-friction material; and surrounding the secondary strand with a plurality of primary strands each including a plurality of fibers formed of a high-friction material, the plurality of primary strands defining an outer surface and a longitudinal center passageway of the rope, the secondary strand being disposed within the passageway.

Independent features and independent advantages of the invention will become apparent to those skilled in the art upon review of the detailed description, drawings and claims.

DETAILED DESCRIPTION

Figure 1:
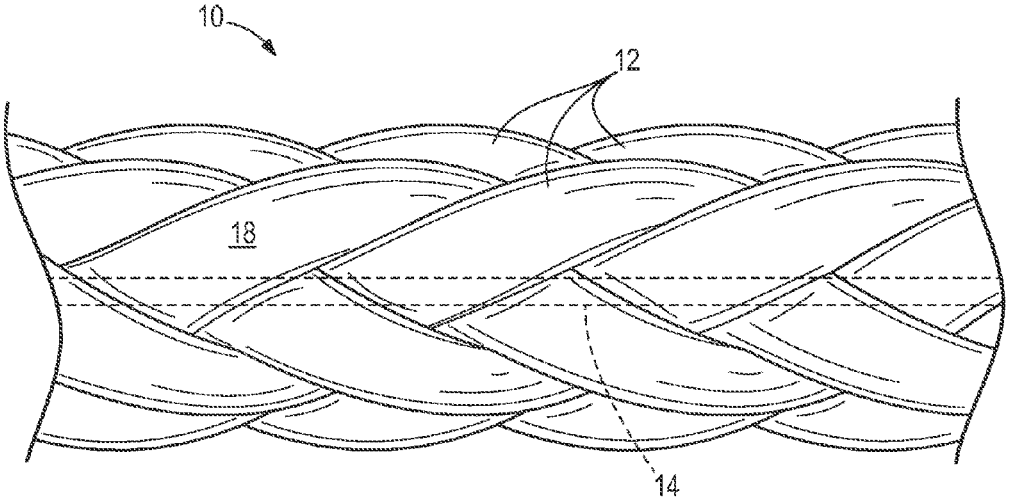
FIG. 1 is a side view of a rope having a low-friction strand, with the low-friction strand shown in phantom lines.

Before any independent embodiments of the invention are explained in detail, it is to be understood that the invention is not limited in its application to the details of construction and the arrangement of components set forth in the following description or illustrated in the following drawings. The invention is capable of other independent embodiments and of being practiced or of being carried out in various ways. Also, it is to be understood that the phraseology and terminology used herein is for the purpose of description and should not be regarded as limiting. Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof.

Referring to FIGS. 1-5, the illustrated rope 10 generally includes a high-friction, load bearing outer jacket or envelope (e.g., high-friction, load bearing outer strands 12 including high-friction fibers 16) surrounding a low-friction, non-load bearing core (e.g., a non-load bearing center strand 14 including structurally stable, non-flowable, low-friction fibers 22). As such, the rope 10 may provide one or more advantages associated with a high-friction outer jacket (e.g., acceptable surface coefficient of friction in applications in which outer surface friction may be desired (winching, splicing, etc.)), and with a low-friction core (e.g., reduced friction and wear on the load bearing strands 12 of the rope 10, as explained in greater detail herein). In other words, the illustrated rope 10 does not sacrifice rope performance to achieve reduced friction and wear.

In addition, because the illustrated low-friction material is separate from the outer strands 12, the low-friction material can be removed from the rope 10, as necessary. For example, the low-friction material can be removed at an end section of the rope 10 for splicing, for termination, etc. In such instances, the section of the rope 10 with the low-friction material removed will perform like a rope without any low-friction material.

It should be understood that the terms "high" and "low" are relative terms. For example, in the illustrated constructions, the outer strands 12 and fibers 16 have a higher coefficient of friction than the core strand 14 and fibers 22 which, in turn, have a lower coefficient of friction than the outer strands 12/fibers 16. Similarly, the outer strands 12 and fibers 16 may have a higher strength than the core strand 14 and fibers 22 which, in turn, have a lower strength than the outer strands 12/fibers 16.

The illustrated rope 10 includes a plurality of primary, load bearing strands 12 surrounding at least one auxiliary, non-load bearing strand 14. The illustrated center strand 14 is a low-friction strand (relative to the illustrated outer strands 12) to reduce the friction at the center of the rope 10, which is where most of the friction occurs. As such, the fibers of the rope 10 are subjected to relatively little wear as they rub against each other, resulting in, for example, an increased useful life compared to previous ropes.

Figure 2:
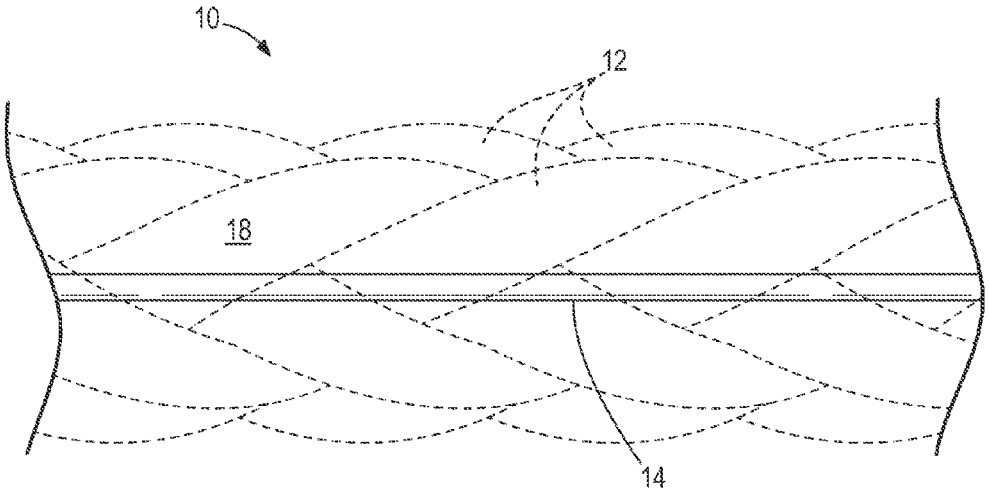
FIG. 2 is a side view of the rope of FIG. 1 with a plurality of outer strands shown in phantom lines.
Figure 3:
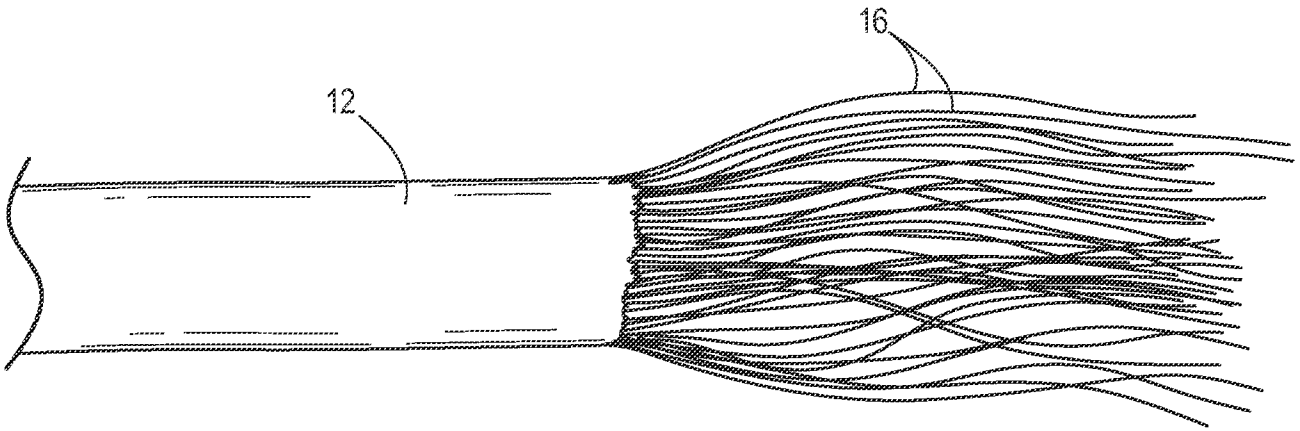
FIG. 3 is a side view of one of the outer strands of the rope of FIG. 1.

Turning to FIGS. 1-3, each outer strand 12 includes a plurality of fibers 16 formed of a high-friction material (that is, not a low-friction material, or a higher friction material relative to the center strand 14 and permitting the rope 10 to be driven by a pulley, sheave, etc.). The material of the fibers 16 is also high strength (e.g., having a higher strength than fibers 22). The outer strands 12 are thus high-strength, high-friction strands to provide a load bearing function and a high surface coefficient of friction for the rope 10.

The fibers 16 may comprise materials such as, without limitation, a recrystallized high modulus polyethylene (for example, Plasma®), a liquid crystal polyester (LCP; for example, Vectran® available from Kuraray Co., Japan), a gel-spun polyethylene (for example, Spectra® available from Honeywell International, Inc., New Jersey, U.S.A.), a para-aramid (for example, Kevlar® available from DuPont, Del., U.S.A. or Twaron® available from Teijin Aramid B.V., The Netherlands), a para-aramid copolymer (for example, Technora® available from Teijin Aramid B.V.), a polyamide (nylon), a polyester, or the like or combinations thereof. The fibers 16 may have a polyurethane finish, although other finishes may alternatively be used.

In some constructions, one or more of the outer strands 12 may include composite strands formed of more than one material, such as more than one of the exemplary materials identified above. In some other constructions (e.g., in which the coefficient of friction of the rope surface is of less importance) and for other aspects of the invention, one or more of the outer strands 12 may include composite strands formed of both high- and low-friction materials. For example, the rope 10 may include a structure similar to that described in U.S. Pat. No. 6,945,153, entitled "Rope for Heavy Lifting Applications", the disclosure of which is also hereby incorporated by reference.

The plurality of outer strands 12 may be braided with one another. For example, the outer strands 12 may be braided in a "12×12" pattern like ropes provided by Cortland Cable of Cortland, N.Y. That is, there may be twelve outer strands 12 braided in a single braid pattern, and each of the twelve outer strands 12 may in turn include twelve sub-strands braided in a single braid pattern. The sub-strands may in turn include a plurality of synthetic fibers 16; each strand 12 may be braided with a center sub-strand formed of a low-friction material (e.g., fibers 22) in a manner similar to the construction of the illustrated rope 10. Similarly, the plurality of outer strands 12 may define a rope structure as described in U.S. Pat. No. 5,901,632, entitled "Rope Construction", the disclosure of which is hereby incorporated by reference.

The rope 10 and/or the plurality of outer strands 12 may alternatively be braided using other patterns (e.g., 12×3, 12×8, etc.) in which the rope or strand is braided with its core separated from its outer surface. In any case, the plurality of outer strands 12 define the outer surface 18 of the rope 10 and an inner longitudinally-extending passageway 20 in which the center strand 14 is disposed.

Figure 4:
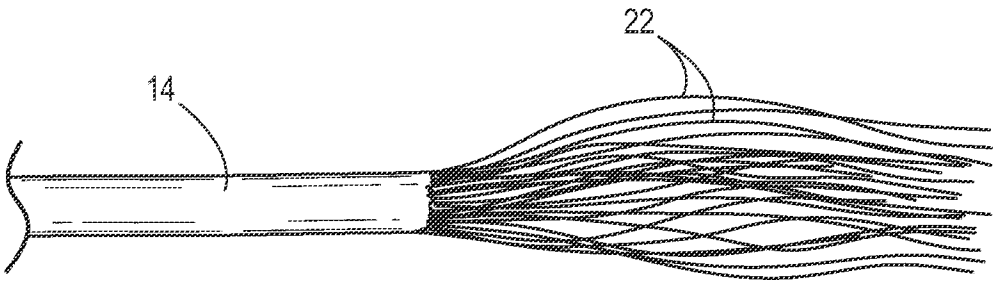
FIG. 4 is a side view of the low-friction strand of the rope of FIG. 1.
Figure 5:
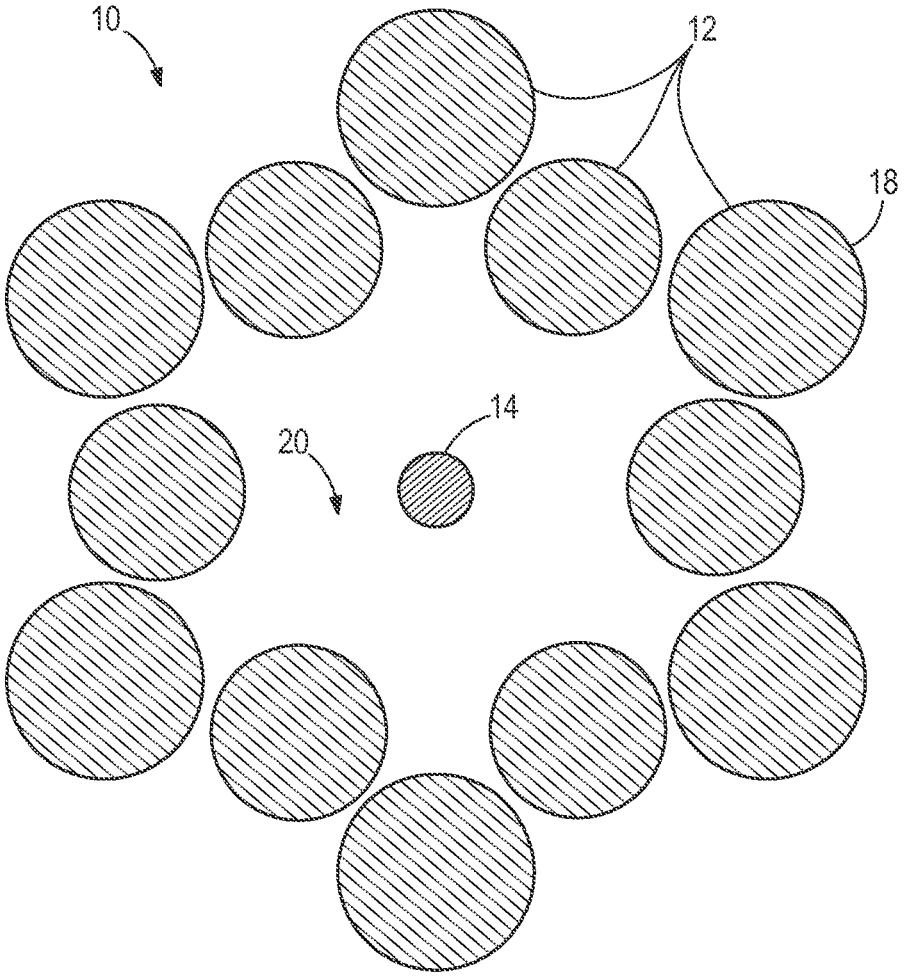
FIG. 5 is a cross-sectional view of the rope of FIG. 1, the space between the various strands is enlarged for clarity.

Turning to FIGS. 2, 4, and 5, the center strand 14 includes a plurality of non-flowable, structurally stable, and solid synthetic fibers 22 formed of a low-friction material (that is, a low-friction material with a coefficient of friction against the high-friction material lower than the coefficient of friction of the high-friction material against itself). In the illustrated construction, the material of the fibers 22 is also low strength (e.g., having a lower strength than the fibers 16). Thus, the illustrated core strand 14 is a low-strength (non-load bearing), low-friction strand providing reduced friction in the center of the rope 10 and, by being structurally-stable and non-flowable, does not impact the surface coefficient of friction of the rope 10.

The fibers 22 may comprise, for example, without limitation, ultra-high molecular weight polyethylene (UHMWPE)-based materials such as low-friction UHMWPE (for example, Dyneema® UHMWPE available from DSM N.V., The Netherlands, Spectra® 900 and Spectra® 1000 available from Honeywell International, Inc., or Endumax® available from Teijin Aramid B.V.), fluoropolymer-based materials such as expanded polytetrafluoroethylene (ePTFE; comprising non-flowable, stable, and solid fibers; for example, Omnibend® available from W. L. Gore & Associates, Inc., Delaware, U.S.A.), modified polytetrafluoroethylene, fluorinated ethylenepropylene (FEP), ethylene-chlorotrifluoroethylene (ECTFE), ethylene-tetrafluoroethylene (ETFE), a perfluoroalkoxy polymer (PFA), or the like or combinations thereof.

In one exemplary rope 10, the fibers 22 of the center strand 14 may comprise a fluoropolymer-based material (e.g., ePTFE), and the fibers 16 of the outer strands 12 may comprise a para-aramid copolymer (for example, Technora®). In another example, the fibers 22 may comprise a fluoropolymer-based material (e.g., ePTFE), and the fibers 16 may comprise UHMWPE.

The material of the fibers 22 is structurally stable and non-flowable, meaning that it stays positioned in the passageway 20 and does not flow, creep or get squeezed out between the outer strands 12 to the outside of the rope 10. The fibers 22 may be braided, twisted, etc.

The fibers 22 and the center strand 14 are disposed in the passageway 20 defined by the outer strands 12 over the entire length of the rope 10. Furthermore, the center strand 14 is separated from the outer surface 18 by at least one of the outer strands 12 at all points along the entire length and about the entire circumference of the rope 10. As such, the center strand 14 reduces the friction at the center of the rope 10, and the fibers 16, 22 are subjected to relatively little wear as they rub against each other.

The diameter of the center strand 14 (or the largest cross-sectional dimension if the strands 12 are compressed against one another) is such that the center strand 14 does not adversely affect the performance of the outer stands 12 and the rope 10 (e.g., does not interfere with the load-carrying capabilities of the outer strands 12). As a practical example, a center strand 14 that is at most one-third of the diameter of each of the outer strands 12 (or the largest cross-sectional dimension) will generally not affect the performance or the outer diameter of a given rope 10. However, it should be understood that the center strand 14 may be smaller or larger (even as large as or larger than the outer strands 12).

In some constructions, the center strand 14 may be formed of a low-friction, high-strength material. In some constructions, the center strand 14 may include a composite strand formed of more than one material, such as more than one of the exemplary materials identified above. In some constructions (not shown), the rope 10 may include more than one center strand 14.

Figure 6:
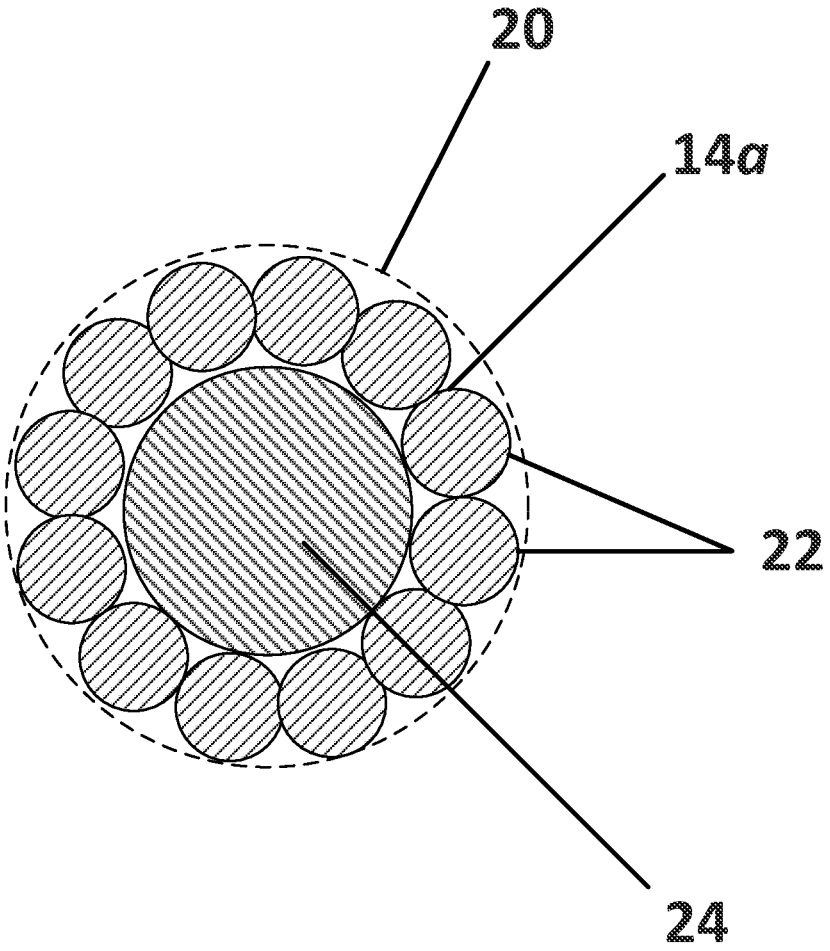
FIG. 6 is a cross-sectional view of an alternative construction of a center strand.

In some other constructions (see FIG. 6) and for other aspects of the invention, the center strand 14*a* may include a hybrid strand formed of one or more of the exemplary low-friction materials identified above in combination with other materials In such constructions, the center strand 14*a* may include a non-load bearing center or core element 24, formed of a material having a relatively higher coefficient of friction than the low-friction material. The core element 24 is surrounded by a low-friction material (e.g., fibers 22), with the low-friction material being between the inner surface of the outer strands 12 and the core element 24 at all points along the entire length and about the entire circumference of the passageway 20.

The core element 24 may be braided. To surround the core element 24, the low-friction material (e.g., fibers 22) may, for example, form a braided jacket or be twisted around the core element 24 to define the low-friction strand 14*a*.

The core element 24 may comprise, for example, without limitation, a multi-filament polyester (available from Kuraray, Co., Japan; Teijin Limited, Japan; or Unifi, Inc., North Carolina, U.S.A.), a para-aramid copolymer (for example, Technora® available from Teijin Aramid B.V.), a liquid crystal polyester (LCP; for example, Vectran® available from Kuraray Co., Japan), a polyamide, a polyester, or the like or combinations thereof.

Such a hybrid center strand construction may be used in larger ropes (e.g., having a diameter of 3⅝" or greater or a circumference of 80 mm or greater) in which a larger passageway 20 can be formed. Relatively-expensive low-friction material can be used with less expensive material of the core element 24 to form a larger center strand 14*a* to occupy the larger passageway 20.

Figure 7:
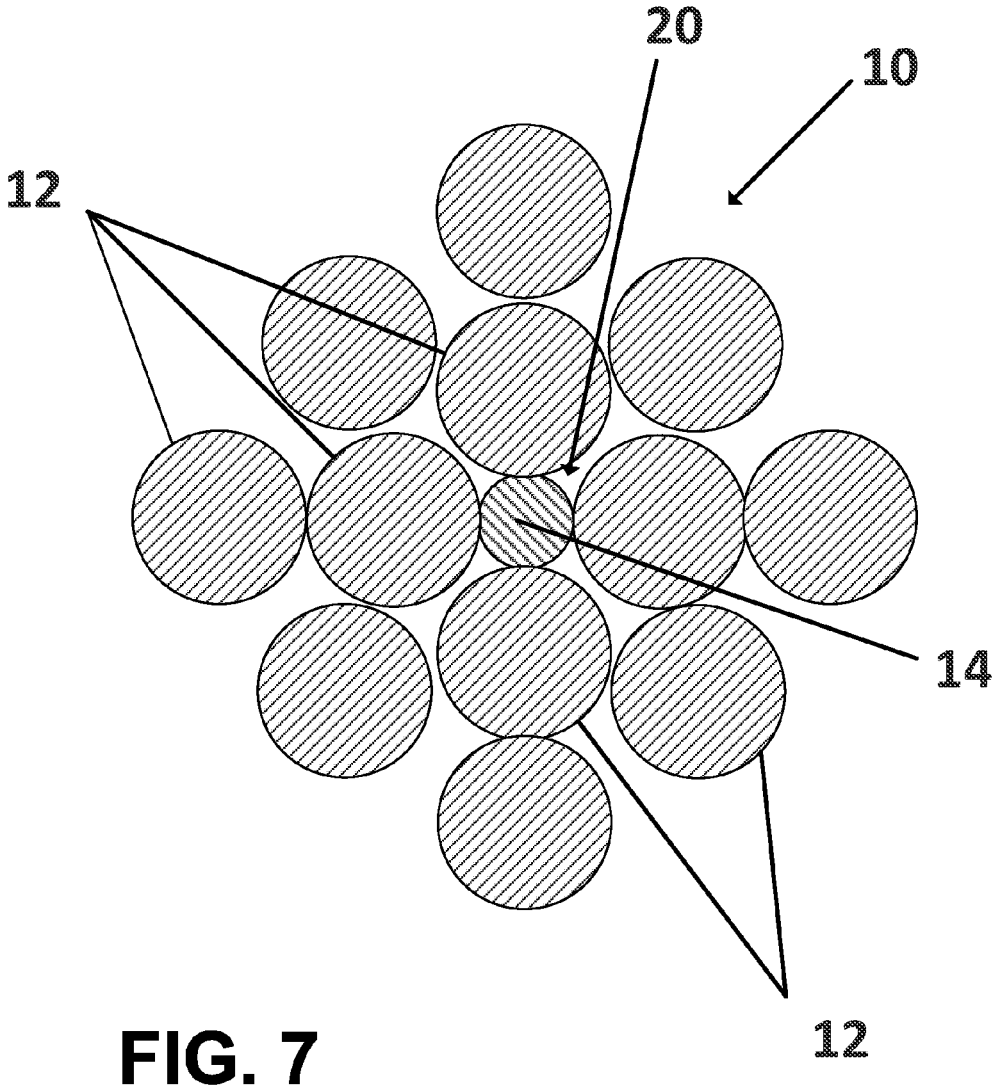
FIG. 7 is a schematic cross-sectional view illustrating use of the rope and engagement of outer strands with the low-friction strand.

When the rope 10 is used, all strands 12, 14 move relative to each other. As the rope 10 is used and tension added (see FIG. 7), the "void" area in the center passageway 20 disappears, and the center strand 14 is in contact with the outer strands 12. The low-friction strand 14 keeps the outer strands 12 from contacting each other at the center and allows the outer strands 12 to move against a low-friction material (e.g., fibers 22) that will not cause damage to the strands 12.

From the above description, it should be apparent that the present invention provides a rope that may include a structurally stable, non-flowable, low-friction center strand to reduce the friction at the center of the rope while maintaining the coefficient of friction of the rope surface. As such, the fibers of the rope may be subjected to reduced wear as they rub against each other, resulting in increased useful life and improved performance compared to previous ropes.

One or more independent features and independent advantages of the invention may be set forth in the following claims:

What is claimed is:

1. A rope comprising:

a plurality of primary strands each including a plurality of fibers comprising a high-friction material, the plurality of primary strands defining an outer surface and a longitudinal center passageway of the rope, the outer surface of the rope being free of low-friction fibers; and a secondary strand disposed within the longitudinal center passageway of the rope and including a plurality of structurally stable fibers, the material of the plurality of fibers of the secondary strand including a low-friction material, the low-friction material being non-flowable when the rope is carrying a heavy tensile load, wherein the low-friction material includes one of low-friction ultra-high molecular weight polyethylene, expanded polytetrafluoroethylene, modified polytetrafluoroethylene, fluorinated ethylenepropylene, ethylene-chlorotrifluoroethylene, ethylene-tetrafluoroethylene, a perfluoroalkoxy polymer or combinations thereof.

2. The rope of claim 1, wherein the low-friction material is configured to remain in the longitudinal center passageway of the rope and does not creep or flow to the outer surface of the rope.

3. The rope of claim 1, wherein the secondary strand is separated from the outer surface by at least one of the plurality of primary strands at all positions along a length of the rope.

4. The rope of claim 1, wherein the low-friction material has a strength lower than the high-friction material.

5. The rope of claim 1, wherein the high-friction material has a strength higher than the low-friction material.

6. The rope of claim 1, wherein the high-friction material includes one of a recrystallized high modulus polyethylene, a liquid crystal polymer, a gel-spun polyethylene, an aramid, a para-aramid, ultra high molecular weight polyethylene, and a nylon.

7. The rope of claim 1, wherein the plurality of primary strands forms a braid around the secondary strand.

8. The rope of claim 1, wherein the entire secondary strand includes the non-flowable, low-friction material.

9. A rope comprising:

a plurality of primary strands each including a plurality of fibers comprising a high-friction material, the plurality of primary strands defining an outer surface and a longitudinal center passageway of the rope; and a secondary strand disposed within the longitudinal center passageway of the rope and including a plurality of structurally stable fibers, the material of the plurality of fibers of the secondary strand including a low-friction material, the low-friction material being non-flowable when the rope is carrying a heavy tensile load;

wherein each of the primary strands are free of low-friction fibers, and wherein the low-friction material includes one of low-friction ultra-high molecular weight polyethylene, expanded polytetrafluoroethylene, modified polytetrafluoroethylene, fluorinated ethylenepropylene, ethylene-chlorotrifluoroethylene, ethylene-tetrafluoroethylene, a perfluoroalkoxy polymer or combinations thereof.

10. A rope comprising:

a plurality of outer strands together defining an outermost surface of the rope and a longitudinally-extending center passageway of the rope, the plurality of outer strands each including a plurality of fibers, the plurality of fibers including a high-friction material defining a first coefficient of friction with itself, the outermost surface of the rope being free of low-friction fibers;

a core strand disposed within the longitudinally-extending center passageway of the rope and separated from the outermost surface by at least one of the plurality of outer strands at all positions along a length of the rope, the core strand including a plurality of structurally stable fibers, the plurality of structurally stable fibers including a low-friction material defining a second coefficient of friction with the high-friction material, the second coefficient of friction being less than the first coefficient of friction, the low-friction material being non-flowable when the rope is carrying a heavy tensile load, wherein the low-friction material includes one of low-friction ultra-high molecular weight polyethylene, expanded polytetrafluoroethylene, modified polytetrafluoroethylene, fluorinated ethylenepropylene, ethylene-chlorotrifluoroethylene, ethylene-tetrafluoroethylene, a perfluoroalkoxy polymer or combinations thereof.

11. The rope of claim 10, wherein the core strand is disposed within the longitudinally-extending center passageway over the length of the rope.

12. The rope of claim 10, wherein the low-friction material has a strength lower than the high-friction material.

13. The rope of claim 10, wherein the high-friction material includes one of a recrystallized high modulus polyethylene, a liquid crystal polymer, a gel-spun polyethylene, an aramid, a para-aramid, ultra high molecular weight polyethylene, and a nylon.

14. The rope of claim 10, wherein the high-friction material has a strength higher than the low-friction material.

15. A rope comprising:

a plurality of outer strands together defining an outermost surface of the rope and a longitudinally-extending center passageway of the rope, the plurality of outer strands each including a plurality of fibers, the plurality of fibers including a high-friction material defining a first coefficient of friction with itself;

a core strand disposed within the longitudinally-extending center passageway of the rope and separated from the outermost surface by at least one of the plurality of outer strands at all positions along a length of the rope, the core strand including a plurality of structurally stable fibers, the plurality of structurally stable fibers including a low-friction material defining a second coefficient of friction with the high-friction material, the second coefficient of friction being less than the first coefficient of friction, the low-friction material being non-flowable when the rope is carrying a heavy tensile load;

wherein each of the plurality of outer strands has a first diameter, and wherein the core strand has a second diameter at most one-third of the first diameter.

16. The rope of claim 10, wherein the plurality of outer strands forms a braid around the core strand.

17. A rope comprising:

twelve outer strands together defining an outermost surface of the rope and a longitudinally-extending center passageway of the rope, the twelve outer strands being braided in a single braid pattern, each of the twelve outer strands including twelve sub-strands braided in a single braid pattern, and each of the sub-strands including a plurality of synthetic fibers, the outermost surface of the rope being free of low-friction fibers; and a core strand disposed in the longitudinally-extending center passageway over the length of the rope, the core strand including a plurality of fibers;

wherein the plurality of synthetic fibers of the twelve outer strands include a high-friction material defining a first coefficient of friction with itself, and wherein the plurality of fibers of the core strand includes a low-friction material defining a second coefficient of friction with the high-friction material, the second coefficient of friction being less than the first coefficient of friction, the low-friction material being non-flowable when the rope is carrying a heavy tensile load, wherein the low-friction material includes one of low-friction ultra-high molecular weight polyethylene, expanded polytetrafluoroethylene, modified polytetrafluoroethylene, fluorinated ethylenepropylene, ethylene-chlorotrifluoroethylene, ethylene-tetrafluoroethylene, a perfluoroalkoxy polymer or combinations thereof.

18. The rope of claim 17, wherein the high-friction material has a strength higher than the low-friction material.

19. The rope of claim 17, wherein the low-friction material has a strength lower than the high-friction material.

20. A rope comprising:

twelve outer strands together defining a longitudinally-extending center passageway of the rope, the twelve outer strands being braided in a single braid pattern, each of the twelve outer strands including twelve sub-strands braided in a single braid pattern, and each of the sub-strands including a plurality of synthetic fibers; and a core strand disposed in the longitudinally-extending center passageway over the length of the rope, the core strand including a plurality of fibers;

wherein the plurality of synthetic fibers of the twelve outer strands include a high-friction material defining a first coefficient of friction with itself, and wherein the plurality of fibers of the core strand includes a low-friction material defining a second coefficient of friction with the high-friction material, the second coefficient of friction being less than the first coefficient of friction, the low-friction material being non-flowable when the rope is carrying a heavy tensile load;

wherein the entire core strand is formed of the non-flowable, low-friction material, and wherein the low-friction material includes one of low-friction ultra-high molecular weight polyethylene, expanded polytetrafluoroethylene, modified polytetrafluoroethylene, fluorinated ethylenepropylene, ethylene-chlorotrifluoroethylene, ethylene-tetrafluoroethylene, a perfluoroalkoxy polymer or combinations thereof.

21. The rope of claim 1, wherein the low-friction material is non-flowable when the rope is carrying a tensile load during heavy lifting.

22. The rope of claim 10, wherein the low-friction material is non-flowable when the rope is carrying a tensile load during heavy lifting.

23. The rope of claim 17, wherein the low-friction material is non-flowable when the rope is carrying a tensile load during heavy lifting.

* * * * *